United States Patent [19]

Zaets et al.

[11] 4,276,088

[45] Jun. 30, 1981

[54] COMPOSITION FOR DIFFUSION COATING OF FERROUS METALS

[76] Inventors: Inna I. Zaets, ulitsa Vorobieva, 11, kv. 8; Nikolai M. Davydenko, ulitsa Komandarma Uborevicha, 14, kv. 45, both of Kharkov; Olga K. Yakshina, ulitsa 16 Parkovaya, 55, korpus 2, kv. 130; Nina F. Pershina, Kutuzovsky prospekt, 2/1, kv. 111, both of Moscow; Valentina D. Demyanenko, ulitsa Tonkopia, 19/3, kv. 85, Kharkov; Jury M. Pavlov, ulitsa Pervomaiskaya, 73, kv. 94, Moscow, all of U.S.S.R.

[21] Appl. No.: 162,651

[22] Filed: Jun. 24, 1980

[51] Int. Cl.[3] ..... C09D 5/10; C23C 9/02

[52] U.S. Cl. ..... 106/1.12; 75/253; 106/1.25; 106/14.05; 427/376.3; 427/376.5

[58] Field of Search ..... 106/1.12, 1.25, 14.05; 75/0.5 R, 253; 427/376.3, 376.5

[56] References Cited

U.S. PATENT DOCUMENTS

| | | | |
|---|---|---|---|
| 2,811,466 | 10/1957 | Samuel | 75/253 |
| 3,096,205 | 7/1963 | De Guisto | 106/1.12 |
| 3,449,151 | 6/1969 | Flicker | 75/253 |

*Primary Examiner*—Lorenzo B. Hayes

[57] ABSTRACT

A composition for a diffusion coating of ferrous metals contains a mixture of ingredients taken in the following ratio (% wt):

titanium 70.0 to 82.0
alumina 14.5 to 20.0
ammonium halide 2.0 to 5.0
graphite 1.0 to 2.0

2 Claims, No Drawings

COMPOSITION FOR DIFFUSION COATING OF FERROUS METALS

BACKGROUND OF THE INVENTION

1. Field of the Invention

The present invention relates to metal protection against corrosion, and particularly to compositions intended for a diffusion coating of ferrous metals. The invention can be used most effectively for corrosion protection of parts and assemblies of the equipment used in chemical industries for the production of soda and soda products, magnesium and barium chlorides, and sodium sulfates.

2. Description of the Prior Art

One of the main problems facing manufacturers of chemical apparatus is the provision of high corrosion resistance in the apparatus parts at minimum cost required. Attempts to apply prior art compositions for the formation of protective coating on the surface of apparatus parts, which operate in highly concentrated salt solutions and chloride-containing media at temperatures of 60° to 100° C., have demonstrated that in many cases these measures either do not compensate for an increase in apparatus service life (when rare elements in compositions and complicated methods of coating are used), or do not provide for any significant increase in corrosion resistance (when cheap compositions and comparatively simple procedure of coating are used). This points to the fact that this problem has not yet been solved satisfactorily enough.

Experience has proved that best results are achieved by a diffusion saturation of ferrous metals with titanium. Known in the art are various compositions for a diffusion coating, which compositions contain titanium or its compounds.

Some attempts are known to use titanium powder for the diffusion coating of ferrous metals (as disclosed in Japanese Patent Publication No. 49-3899). Metallic titanium is applied to the structural component by any convential method e.g. vacuum spraying. The coating obtained is a solid solution of titanium in iron and does not contain the carbide phase. For this reason its corrosion resistance is low, and structural components made of ferrous metals and protected with such a coating cannot resist long-term contact with aggressive liquids.

There is known a composition for the diffusion coating of ferrous metals which composition containing titanium compound (titanium carbide, nitride or carbonitride), alkaline halohemide (chlorine or fluorine). The composition is applied to a workpiece being coated in an isothermal chamber in an atmosphere of inert gas, hydrocarbon or nitrogenated gas at temperatures of 800° to 1150° C. as disclosed in French Patent No. 2181512. This composition contains titanium carbides which provide for a better resistance of the coating in comparison with that as above described.

However, titanium nitride or carbonitride contained in the coating composition causes a considerable increase in hardness (up to 1800 kg/mm$^2$ Vickers hardness), and a corresponding decrease in plasticity and corrosion resistance. If the coating consists of titanium carbide only, the diffusion layer is of inadequate continuity and does not resist aggressive media. Besides, the method of applying such composition is not economically feasable because of high cost of the inert gas used in the process.

Known in the art is a composition for the diffusion coating of ferrous metals and containing a particulate mixture of titanium, alumina and ammonium halide in the following ratio (% wt):

titanium: 75
alumina: 24
ammonium chloride: 1

This composition is a powdered mixture which is heated during the coating process together with the workpieces in a hermetically sealed container at 1050° C. and is held at this temperature for 3 hours (see A. N. Minkevich, Khimiko-termicheskaya obrabotka metallov i splavov, Moskva, "Mashinostroyenie" 1965, p.294).

This composition makes it possible to obtain a coating of adequate continuity in the diffusion layer due to the presence of alumina inert admixture and provides for formation of titanium carbide, titanium compounds with iron, and titanium nitrides in the diffusion layer.

As can be seen from the referenced publication, diffusion layer application is a comparatively simple procedure and does not involve the use of such an expensive auxiliary raw material as inert gas. However, corrosion resistance of such diffusion layer is adversely affected by titanium nitrides which are formed during interaction of air, nitrogen, and ammonia with titanium while being heated. Titanium nitrides significantly increase brittleness of the diffusion layer and are comparatively easily solved in such chloride-containing media and highly concentrated salt solutions. Amount of nitrides in the diffusion layer could be decreased by a protective atmosphere of inert gas in the process of diffusion layer application. However, this would bring about considerable additional expenses.

SUMMARY OF THE INVENTION

A principal object of the invention is to provide a composition for a diffusion coating of ferrous metals, which composition could be utilized without protective inert atmosphere.

A further important object of the invention is to provide a composition preventing nitride formation in the diffusion layer.

Another object of the invention is to provide a composition for a diffusion coating, providing for an increase in corrosion resistance of a protective coating.

Another object of the invention is to increase continuity of the diffusion layer.

An additional object of the invention is to provide an effective and cheap composition for a diffusion coating, applicable without a protective inert atmosphere.

Still another object of the invention is to provide a composition for a diffusion coating, usable for protection of workpieces subjected to the action of highly concentrated salt solutions and chloride-containing media.

The above-mentioned and other objects of the present invention are achieved by providing a composition for a diffusion coating of ferrous metals, which composition contains a particulate mixture of titanium, alumina and ammonium halide, and according to the invention, furhter contains graphite, and said ingredients are taken in the following ratio (% wt):

titanium: 70.0 to 82.0
alumina: 14.5 to 20.0
ammonium halide: 2.0 to 5.0
graphite: 1.0 to 2.0

Carbon which is contained in the form of graphite in the composition, significantly intensifies formation of carbides in the course of application of the diffusion layer and in such a way prevents formation of titanium nitrides in the diffusion layer. This also promotes an increase in amount of the titanium carbides in the diffusion layer. The increase in amount of the carbides in its turn brings about an increase in concentration of titanium in the surface layer. All the above-mentioned factors make it possible to increase corrosion resistance of the diffusion layer without a significant increase in expenses required for its application.

The best results are achieved when graphite is used in the composition, the graphite being in the powder form with particle size ranging from 0.8 to 1.5 mm.

DETAILED DESCRIPTION OF THE INVENTION

EXAMPLE 1

The composition for a diffusion coating of ferrous metals is obtained as follows. Titanium, alumina, crystalline ammonium chloride and graphite, all in the powder form, are taken as initial ingredients. Particles of the titanium powder are ranging in size from 0.8 to 1.5 mm. Alumina and ammonium chloride are taken in the powder form with particles of said substances having different dispersion characteristics and ranging from dust-like fraction to particles sizing 1.5 mm.

Particles of the graphite powder are 0.8 mm in size. The initial ingredients are taken in the following ratio (% wt):

titanium: 70.0
alumina: 27.0
ammonium chloride: 2.0
graphite: 1.0

All the above ingredients are stirred to obtain a homogeneous mixture.

Formation of the diffusion layer with the composition obtained on the workpiece such as a pump casing, valve casing, parts of housings for column apparatus made of 3.5% carbon content cast-iron castings, is carried out as follows.

A hermetically sealed container of stainless steel is loaded with workpieces and than with the composition of the invention. The container is closed, placed into the furnace and heated up to 1000° C. At this temperature the content of the container is held for 8 hours. In the process of heating and holding, a continuous plastic diffusion layer having total thickness of 0.16 to 0.20 mm is being formed on the surface of the workpieces. After holding, the container with the workpieces treated is air-cooled.

Similarly, samples together with said workpieces were treated in the same container in order to form a diffusion layer on their surface. The samples were made of cast-iron containing 3.5% C and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the methods described below.

The layer hardness was determined by the Vickers method (Hv kg/mm$^2$). Continuity of the layer was determined by means of the Wacker reagent (a mixture of $K_3[Fe(CN)_6]$ and NaCl). In doing this, filter paper moistened with said reagent was laid into the surface of the samples. Galvanic pairs "iron in substrate-reagent" were formed in the pore zones. Ions of iron with ions of $[Fe(CN_6)]^{3-}$ formed the $Fe_3[Fe(CN)_6]$ compound known as Turnball's blue. Location of pores was fixed on the filter paper by the blue spots.

Corrosion resistance of the layer was determined as follows. The samples were immersed into solutions of salts and their mixtures and held for 1200 hours. During this process the temperature of the salt solution was 25° C., and the temperature of the mixture of ammonium chloride and sodium chloride was 60° C. and the mixture of sodium carbonate and sodium bicarbonate was 100° C. Corrosion resistance was evaluated as a decrease in sample weight per unit surface area taking into account a test duration. Corrosion magnitude was determined taking into account the specific weight of the material in mm/year.

Test results appeared to be as follows:

Vickers hardness of the diffusion layer HV, kg/mm$^2$: 970 layer continuity, number of spots per cm$^2$: 0 corrosion resistance, mm/year:

in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l): 0.001
in the mixture of sodium carbonate and sodium bicarbonate respectively (250 g/l and 50 g/l): 0.002
in potassium carbonate (100 g/l): 0.001

EXAMPLE 2

The composition for a diffusion coating of ferrous metals is obtained as follows. Titanium, alumina, crystalline ammonium halide (ammonium iodide) and graphite, all in the powder form are taken as initial ingredients. Particles of the titanium powder are ranging in size from 0.8 to 1.5 mm. Alumina and ammonium iodide are taken in the powder form with particles of said substances having different dispersion characteristics and ranging from dust-like fraction to particles sizing 1.5 mm. Particles of the graphite powder are 1.5 mm in size. The initial ingredients are taken in the following ratio (% wt):

titanium: 72.0
alumina: 24.5
ammonium iodide: 2.0
graphite: 1.5

All the above ingredients are stirred to obtain a homogeneous mixture.

With the composition obtained the diffusion layer on workpieces such as pump casing, fittings and parts of housings for column apparatus and valve made of 3.57% carbon content cast-iron castings is formed as follows.

A hermetically sealed container of stainless steel is loaded with workpieces and then filled with the composition of the invention. The container is closed, placed into the furnace and heated up to 1000° C. At this temperature the content of the container is held for 8 hours. In the process of heating and holding, a continuous plastic diffusion layer having total thickness of 0.16 to 0.20 mm is being formed on the surface of the workpieces.

After holding, the container with the workpieces treated is air-cooled.

Similarly, samples together with said workpieces were treated in the same container. The samples were made of cast-iron containing 3.57% C, and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 970 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (respectively 180 g/l and 70 g/l): 0.001 in the mixture of sodium carbonate and sodium bicarbonate (respectively 250 g/l and 50 g/l): 0.002 in potassium carbonate (100 g/l): 0.001

EXAMPLE 3

The composition for a diffusion coating of ferrous metals is obtained as follows. Titanium, alumina, crystalline ammonium bromide and graphite, all in the powder form, are taken as initial ingredients. Particles of the titanium powder are ranging in size from 0.8 to 1.5 mm. Alumina and ammonium bromide are taken in the powder form with particles of said substances having different dispersion characteristics and ranging from dust-like fraction to particles sizing 1.5 mm. Particles of the graphite powder are 1.0 mm in size. The initial ingredients are taken in the following ratio (% wt):

titanium: 75.0 alumina: 21.0 ammonium bromide: 2.0 graphite: 2.0

All the above ingredients are stirred to obtain a homogeneous mixture.

With the composition obtained the diffusion layer on workpiece such as fittings and parts of housings for column apparatus and valve made of 3.57% carbon content cast-iron castings is formed as follows.

A hermetically sealed container of stainless steel is loaded with workpieces and then with the composition of the invention. The container is closed, placed into the furnace and heated up to 1000° C. At this temperature the content of the container is held for 8 hours. In the process of heating and holding, a continuous plastic diffusion layer having total thickness of 0.16 to 0.20 mm is being formed on the surface of the workpieces. After holding, the container with the workpieces treated is air-cooled.

Similarly, samples together with said workpieces were treated in the same container. The samples were made of cast-iron containing 3.57% C and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 970 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (respectively 180 g/l and 70 g/l): 0.001 in the mixture of sodium carbonate and sodium bicarbonate (respectively 250 g/l and 50 g/l): 0.002 in potassium carbonate (100 g/l): 0.001

EXAMPLE 4

The composition for a diffusion coating of ferrous metals is obtained as follows. Titanium, alumina, crystalline ammonium halide (ammonium fluoride) and graphite, all in the powder form, are taken as initial ingredients. Particles of the titanium powder are ranging in size from 0.8 to 1.5 mm. Alumina and ammonium fluoride are taken in the powder form with particles of said substances having different dispersion characteristics and ranging from dust-like fraction to particles sizing 1.5 mm. Particles of the graphite powder are 0.8 mm in size. The initial ingredients are taken in the following ratio (% wt):

titanium: 76.0 alumina: 19.5 ammonium fluoride: 2.5 graphite: 2.0

All the above ingredients are stirred to obtain a homogeneous mixture.

With the composition obtained the diffusion layer on workpiece such as pump casing, fittings and parts of housings for column apparatus and valve made of 3.57% carbon content cast-iron castings is formed as follows.

A hermetically sealed container of stainless steel is loaded with workpieces and then filled with the composition of the invention. The container is closed, placed into the furnace and heated up to 1000° C. At this temperature the content of the container is held for 8 hours. In the process of heating and holding, a continuous plastic diffusion layer having total thickness of 0.16 to 0.20 mm is being formed on the surface of the workpieces. After holding, the container with the workpieces treated is air-cooled.

Similarly, samples together with said workpieces were treated in the same container. The samples were made of cast-iron containing 3.57% C and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 970 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (respectively 180 g/l and 70 g/l): 0.001
in the mixture of sodium carbonate and sodium bicarbonate (respectively 250 g/l and 50 g/l): 0.002
in potassium carbonate (100 g/l): 0.001

EXAMPLE 5

The composition for a diffusion coating of ferrous metals is obtained as follows. Titanium, alumina, crystalline ammonium halide (ammonium chloride) and graphite, all in the powder form are taken as initial ingredients. Particles of the titanium powder are ranging in size from 0.8 to 1.5 mm. Alumina and ammonium chloride are taken in the powder form with particles of said substances having different dispersion characteristics and ranging from dust-like fraction to particles sizing 1.5 mm. Particles of the graphite powder are 1.2 mm in size. The initial ingredients are taken in the following ratio (% wt):
titanium: 73.0
alumina: 22.5
ammonium chloride: 3.0
graphite: 1.5

All the above ingredients are stirred to obtain a homogeneous mixture.

With the composition obtained the diffusion layer on workpiece such as pump casing, fittings and parts of housings for column apparatus made of 2% carbon content cast-iron castings is formed as follows.

A hermetically sealed container of stainless steel is loaded with workpieces and then filled with the composition of the invention.

The container is closed, placed into the furnace and heated up to 950° C. At this temperature the content of the container is held for 6 hours. In the process of heating and holding, a continuous plastic diffusion layer having total thickness of 0.20 to 0.22 mm is being formed on the surface of the workpieces. After holding, the container with the workpieces treated is air-cooled. Similarly, samples together with said workpieces were treated in the same container in order to form a diffusion layer on the surface thereof. The samples were made of grey pig iron containing 2% C and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:
Vickers hardness of the diffusion layer HV, kg/mm$^2$: 1000
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l): 0.002
in the mixture of sodium carbonate and sodium bicarbonate (respectively 250 g/l and 50 g/l): 0.002
in potassium carbonate (100 g/l): 0.001

Example 6

The composition for a diffusion coating of ferrous metals is obtained as follows. Titanium, alumina, crystalline ammonium halide (ammonium iodide) and graphite, all in the powder form, are taken as initial ingredients. Particles of the titanium powder are ranging in size from 0.8 to 1.5 mm. Alumina and ammonium iodide are taken in the powder form with particles of said substances having different dispersion characteristics and ranging from dust-like fraction to particles sizing 1.5 mm. Particles of the graphite powder are 1.5 mm in size. The initial ingredients are taken in the following ratio (% wt):
titanium: 71.0
alumina: 25.2
ammonium iodide: 2.5
graphite: 1.3

All the above ingredients are stirred to obtain a homogeneous mixture.

With the composition obtained the diffusion layer on workpiece such as pump casing, fittings and parts of housings for column apparatus and valve made of 4.5% carbon content grey pig iron is formed as follows.

A hermetically sealed container of stainless steel is loaded with workpieces and then filled with the composition of the invention.

The container is closed, placed into the furnace and heated up to 950° C. At this temperature the content of the container is held for 6 hours. In the process of heating and holding, a continuous plastic diffusion layer having total thickness of 0.20 to 0.22 mm is being formed on the surface of the workpieces. After holding, the container with the workpieces treated is air-cooled.

Similarly, samples together with said workpieces were treated in the same container in order to form a diffusion layer on the surface thereof. The samples were made of grey pig iron containing 4.5% C and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:
Vickers hardness of the diffusion layer HV, kg/mm$^2$: 1000
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l): 0.002
in the mixture of sodium carbonate and sodium bicarbonate (respectively 250 g/l and 50 g/l): 0.002
in potassium carbonate (100 g/l: 0.001

Example 7

The composition for a diffusion coating of ferrous metals is obtained as follows. Titanium, alumina, crystalline ammonium and halide (ammonium bromide) graphite all in the powder form, are taken as initial ingredients. Particles of the titanium poweder are ranging in size from 0.8 to 1.5 mm. Alumina and ammonium bromide are taken in the powder form with particles of said substances having different dispersion characteristics and ranging from dust-like fraction to particles sizing 1.5 mm. Particles of the graphite powder are 0.8 mm in size. The initial ingredients are taken in the following ratio (% wt):
titanium: 72.5
alumina: 24.3
ammonium bromide: 2.0
graphite: 1.2

All the above ingredients are stirred to obtain a homogeneous mixture.

With the composition obtained the diffusion layer on workpiece such as pump casing, fittings and parts of housings for column apparatus and valve made of 3% carbon content gray pig iron is formed as follows.

A hermetically sealed container of stainless steel is loaded with workpieces and then filled with the composition of the invention.

The container is closed, placed into the furnace and heated up to 950° C. At this temperature the content of the container is held for 6 hours. In the process of heating and holding, a continuous plastic diffusion layer having total thickness of 0.20 to 0.22 mm is being formed on the surface of the workpieces. After holding, the container with the workpieces treated is air-cooled.

Similarly, samples together with said workpieces were treated in the same container in order to form a diffusion layer on the surface thereof. The samples were made of grey pig iron containing 3% C and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:
Vickers hardness of the diffusion layer HV, kg/mm$^2$: 1000
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l): 0.002
in the mixture of sodium carbonate and sodium bicarbonate (respectively 250 g/l and 50 g/l): 0.002
in potassium carbonate (100 g/l): 0.001

Example 8

The composition for a diffusion coating of ferrous metals is obtained as follows. Titanium, alumina, crystalline ammonium halide (ammonium fluoride) and graphite, all in the powder form, are taken as initial ingredients. Particles of the titanium powder, alumina and ammonium fluoride powders are of similar size as those described in Example 1.

Particles of the graphite powder are 1.0 mm in size. The initial ingredients are taken in the following ratio (% wt):
titanium: 71.5
alumina: 24.7
ammonium fluoride: 2.5
graphite: 1.3

All the above ingredients are stirred to obtain a homogeneous mixture.

The composition thus obtained is used to form the diffusion layer on workpieces such as pump casing, fittings and parts of housings for column apparatus and valve made of 2.5% carbon content grey pig iron.

The diffusion layer is being formed in the way described in Example 1. Heating is carried out at 950° C. and holding time is 6 hours. The diffusion layer formed has total thickness of 0.20 to 0.22 mm.

Similarly, samples together with the workpieces were treated in the way described in Example 1 in order to form a diffusion layer on the surface thereof. The samples were made of grey pig iron containing 2.5% C and were 65×15×3 mm rectangular plates.

After the diffusion layer has been formed, the samples were subjected to X-ray analysis in order to determine the nature of phases constituting the diffusion layer and hardness, continuity and corrosion resistance of said layer were determined by the techniques described in Example 1.

Test results appeared to be as follows:
Vickers hardness of the diffusion layer HV, kg/mm$^2$: 1000
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l): 0.002
in the mixture of sodium carbonate and sodium bicarbonate (respectively 250 g/l and 50 g/l): 0.002
in potassium carbonate (100 g/l): 0.001

Example 9

The composition for a diffusion coating of ferrous metals is obtained as follows. Titanium, alumina, crystalline ammonium halide (ammonium chloride) and graphite, all in the powder form, are taken as initial ingredients. Particles of titanium, alumina and ammonium chloride powders are similar is size to those described in Example 1.

Particles of the graphite powder are 0.8 mm in size. The initial ingredients are taken in the following ratio (% wt):
titanium: 76.0
alumina: 21.0
ammonium chloride: 2.0
graphite: 1.0

All the above ingredients are stirred to obtain a homogeneous mixture.

The composition thus obtained is used for the diffusion layer to be formed on workpieces such as pump casing, fittings and parts of housings for column apparatus and valves made of low-alloy cast iron containing chromium, nickel and molybdenum up to 3%.

The diffusion layer is being formed in the way described in Example 1. Heating is carried out at 1000° C., and duration of holding is 7 hours. The diffusion layer being formed has total thickness of 0.8 mm.

Similarly, samples together with the workpieces were treated in the way described in Example 1 in order to form a difusion layer on the surface thereof. The samples were made of low-alloy cast iron containing up to 3% chromium, nickel and molybdenum, and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 950 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (respectively 180 g/l and 70 g/l): 0.002 in the mixture of sodium carbonate and sodium bicarbonate (respectively 250 g/l and 50 g/l): 0.002 in potassium carbonate (100 g/l): 0.001

Example 10

The composition for a diffusion coating of ferrous metals is obtained as follows. Titanium, alumina, crystalline ammonium halide (ammonium iodide) and graphite, all in the powder form, are taken as initial ingredients. Particles of titanium alumina and ammonium iodide powders are sizing similar to those described in Example 1. Particles of the graphite powder are 1.0 mm in size. The initial ingredients are taken in the following ratio (% wt):

titanium: 74.5 alumina: 21.8 ammonium iodide: 2.5 graphite: 1.2

All the above ingredients are stirred to obtain a homogeneous mixture.

The composition thus obtained is used for application of the diffusion layer to workpieces such as fittings and parts of housings for column apparatus and valves made of low-alloy cast iron containing up to 3% chromium, nickel and molybdenum.

The diffusion layer is being formed in the way described in Example 1. Heating is carried out at 1000° C., and duration of holding is 7 hours. The diffusion layer being formed has total thickness of 0.22 to 0.25 mm.

Similarly, samples together with the workpieces were treated in the way described in Example 1 in order to form a diffusion layer on the surface thereof. The samples were made of low-alloy cast iron containing up to 3% chromium, nickel and molybdenum, and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 950 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (respectively 180 g/l and 70 g/l): 0.002 in the mixture of sodium carbonate and sodium bicarbonate (respectively 250 g/l and 50 g/l): 0.002 in potassium carbonate (100 g/l): 0.001

Example 11

The composition for a diffusion coating of ferrous metals is obtained as follows. Titanium, alumina, crystalline ammonium halide (ammonium bromide) and graphite, all in the powder form are taken as initial ingredients. Particles of the titanium powder are ranging in size from 0.8 to 1.5 mm. Alumina and ammonium bromide are taken in the powder form with particles of said substances having different dispersion characteristics and ranging from dust-like fraction to particles sizing 1.5 mm. Particles of graphite are 1.5 mm in size. Said initial ingredients are taken in the following ratio (% wt):

titanium: 73.0 alumina: 23.7 ammonium bromide: 2.0 graphite: 1.3

The above ingredients are stirred to obtain a homogeneous mixture.

With the composition obtained the diffusion layer on workpiece such as pump casing, fittings and parts of housings for column apparatus made of low-alloy cast iron containing up to 3% chromium, nickel and molybdenum is formed as follows. A hermetically sealed container of stainless steel is loaded with workpieces and then filled with the composition of the invention. The container is closed, placed into the furnace and heated up to 1000° C. At this temperature the content of the container is held for 7 hours. In the process of heating and holding, a continuous plastic diffusion layer having total thickness of 0.22 to 0.25 mm is being formed on the surface of the workpieces. After holding, the container with the workpieces treated is air-cooled.

Similarly, samples together with said workpieces were treated in the same container in order to form a diffusion layer on the surface thereof. The samples were made of low-alloy cast iron containing up to 3% chromium, nickel and molybdenum, and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 950 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (respectively 180 g/l and 70 g/l): 0.002 in the mixture of sodium carbonate and sodium bicarbonate (respectively 250 g/l and 50 g/l): 0.002 in potassium carbonate (100 g/l): 0.001

EXAMPLE 12

The composition for a diffusion coating of ferrous metals is obtained as follows. Titanium, alumina, crystalline ammonium halide (ammonium chloride) and graphite, all in the powder form are taken as initial ingredients. Particles of the titanium powder are ranging in size from 0.8 to 1.5 mm. Alumina and ammonium chloride are taken in the powder form with particles of said substances having different dispersion characteristics and ranging from dust-like fraction to particles sizing 1.5 mm. Particles of the graphite powder are 0.8 mm in size. The above initial ingredients are taken in the following ratio (% wt):

titanium: 72.0
alumina: 24.3
ammonium chloride: 2.5
graphite: 1.2

The ingredients are stirred to obtain a homogeneous mixture.

With the composition obtained the diffusion layer on workpiece such as pump casing, fittings and parts of housings for column apparatus made of medium-alloy cast iron containing 3 to 10% chromium, nickel and molybdenum, is formed as follows. A hermetically sealed container of stainless steel is loaded with workpieces and then filled with the composition of the invention. The container is closed, placed into the furnace and heated up to 1000° C. At this temperature the content of the container is held for 6 hours. In the process of heating and holding, a continuous plastic diffusion layer having total thickness of 0.20 to 0.23 mm is being formed on the surface of the workpieces. After holding, the container with the workpieces treated is air-cooled.

Similarly, samples together with said workpieces were treated in the same container in order to form a diffusion layer on the surface thereof. The samples were made of medium-alloy cast iron containing 3 to 10% chromium, nickel and molybdenum and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the technique described in Example 1.

Test results appeared to be as follows:

Vickers hardness of the diffusion layer HV, kg/mm$^2$: 980
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l): 0.002
in the mixture of sodium carbonate and sodium bicarbonate (respectively 250 g/l and 50 g/l): 0.002
in potassium carbonate (100 g/l): 0.001

EXAMPLE 13

The composition for a diffusion coating of ferrous metals is obtained as follows. Titanium, alumina, crystalline ammonium halide (ammonium iodide) and graphite, all in the powder form, are taken as initial ingredients. Particles of the titanium powder are ranging in size from 0.8 to 1.5 mm. Alumina and ammonium iodide are taken in the powder form with particles of said substances having different dispersion characteristics and ranging from dust-like fraction to particles sizing 1.5 mm. Particles of the graphite powder are 1.2 mm in size. Said initial ingredients are taken in the following ratio (% wt):

titanium: 71.5
alumina: 25.2
ammonium iodide: 2.0
graphite: 1.3

These ingredients are stirred to obtain a homogeneous mixture.

With the composition obtained the diffusion layer on such workpieces as pump impellers, fittings and parts of housings for column apparatus made of cast iron containing 3 to 10% chromium, nickel and molybdenum, is formed as follows. A hermetically sealed container of stainless steel is loaded with workpieces and then filled with the composition of the invention. The container is closed, placed into the furnace and heated up to 1000° C. At this temperature the content of the container is held for 6 hours. In the process of heating and holding, a continuous plastic diffusion layer having total thickness of 0.20 to 0.23 mm is being formed on the surface of the workpieces. After holding, the container with the workpieces treated is air-cooled.

Similarly, samples together with said workpieces were treated in the same container in order to form a diffusion layer on the surface thereof. The samples were made of cast iron containing 3 to 10% chromium, nickel and molybdenum, and were 65×15×3 mm rectangular plates.

After the diffusion layer has been formed, the samples were subjected to X-ray analysis in order to determine the nature of phases constituting the diffusion layer, and hardness, continuity and corrosion resistance were determined by the techniques described in Example 1.

Test results appeared to be as follows:

Vickers hardness of the diffusion layer HV, kg/mm$^2$: 980
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l): 0.002
in the mixture of sodium carbonate and sodium bicarbonate (respectively 250 g/l and 50 g/l): 0.002
in potassium carbonate (100 g/l): 0.001

Example 14

The composition for a diffusion coating of ferrous metals is obtained as follows. Titanium, alumina, crystalline ammonium halide (ammonium fluoride) and graphite, all in the powder form, are taken as initial ingredients. Particles of titanium, alumina, ammonium fluoride powders are similar in size to those described in Example 1. Particles of graphite are 1.5 mm in size. The initial ingredients are taken in the following ratio (% wt):

titanium: 72.5
alumina: 24.5
ammonium fluoride: 2.0
graphite: 1.0

Said ingredients are stirred to obtain a homogeneous mixture.

The composition thus obtained is used for the diffusion layer to be formed on workpieces made of cast iron containing 3 to 10% chromium, nickel and molybdenum.

The diffusion layer is being formed in the way described in Example 1. The following conditions should be maintained during the layer formation: temperature 1000° C., holding for 6 hours. The diffusion layer being formed on the surface of workpieces has total thickness of 0.20 to 0.23 mm.

Similarly, samples made of cast iron containing 3 to 10% chromium, nickel and molybdenum were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 980 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (respectively 180 g/l and 70 g/l): 0.003 in the mixture of sodium carbonate and sodium bicarbonate (respectively 250 g/l and 50 g/l): 0.002 in potassium carbonate (100 g/l): 0.001

Example 15

The composition for a diffusion coating of ferrous metals is obtained as follows. Titanium, alumina, crystalline ammonium halide (ammonium chloride) and graphite, all in the powder form, are taken as initial ingredients. Particles of titanium, alumina and ammonium chloride are similar in size to those described in Example 1. Particles of graphite are 1.2 mm in size. The initial ingredients are taken in the following ratio (% wt):

titanium: 70.0 alumina: 26.5 ammonium chloride: 2.5 graphite: 1.0

Said ingredients are stirred to obtain a homogeneous mixture.

The composition thus obtained is used for the diffusion layer to be formed on workpieces made of high-alloy cast iron containing more than 10% chromium, nickel and molybdenum.

The diffusion layer is being formed in the way described in Example 1. The following conditions should be maintained during the layer formation: temperature, 1000° C.; holding, 6 hours. The continuous plastic diffusion layer being formed on the surface of the workpieces has total thickness of 0.18 to 0.20 mm.

Similarly, samples together with the workpieces were treated; said samples were made of high-alloy cast iron containing more than 10% chromium, nickel and molybdenum.

After the diffusion has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 1000 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (respectively 180 g/l and 70 g/l): 0.003 in the mixture of sodium carbonate and sodium bicarbonate (respectively 250 g/l and 50 g/l): 0.002 in potassium carbonate (100 g/l): 0.001

Example 16

The composition for a diffusion coating of ferrous metals is obtained as follows. Titanium, alumina, crystalline ammonium bromide and graphite all in the powder form are taken as initial ingredients. Particles of titanium, alumina and ammonium bromide are similar in size to those described in Example 1. Particles of graphite are 0.8 mm in size. The initial ingredients are taken in the following ratio (% wt):

titanium: 70.5 alumina: 25.4 ammonium bromide: 3.0 graphite: 1.1

Said ingredients are stirred to obtain a homogeneous mixture.

The composition thus obtained is used for the diffusion layer to be formed workpieces made of high-alloy cast iron containing more than 10% chromium, nickel and molybdenum.

The diffusion layer is being formed in the way described in Example 1. The following conditions should be maintained during the layer formation: temperature, 1000° C.; holding time, 6 hours. The continuous plastic diffusion layer being formed on the surface of workpieces has total thickness of 0.18 to 0.20 mm.

Similarly, samples made of high-alloy cast iron containing more than 10% chromium, nickel and molybdenum were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 1000 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (respectively 180 g/l and 70 g/l): 0.003 in the mixture of sodium carbonate and sodium bicarbonate (respectively 250 g/l and 50 g/l): 0.002 in potassium carbonate (100 g/l): 0.001

Example 17

The composition for a diffusion coating of ferrous metals is obtained as follows. Titanium, alumina, crystalline ammonium halide (ammonium fluoride) and graphite, all in the powder form, are taken as initial ingredients. Particles of titanium, alumina, and ammonium fluoride powders are similar in size to those described in Example 1. Particles of graphite are 0.8 mm in size. The initial ingredients are taken in the following ratio (% wt):

titanium: 71.0
alumina: 25.0
ammonium fluoride: 3.0
graphite: 1.0

Said ingredients are stirred to obtain a homogeneous mixture.

The composition thus obtained is used for the diffusion layer to be formed on workpieces made of high-alloy cast iron containing more than 10% chromium, nickel and molybdenum.

The diffusion layer is being formed in the way described in Example 1. The following conditions should be maintained during the layer formation: temperature, 1000° C.; holding 6 hours. The continuous plastic diffusion layer formed on the surface of the workpieces has total thickness of 0.18 to 0.20 mm.

Similarly, samples made of high-alloy cast iron containing more than 10% chromium, nickel and molybdenum were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 1000
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l): 0.003
in the mixture of sodium carbonate and sodium bicarbonate (respectively 250 g/l and 50 g/l): 0.002
in potassium carbonate (100 g/l): 0.001

Example 18

The composition for a diffusion coating of ferrous metals is obtained as follows. Titanium, alumina, crystalline ammonium halide (ammonium chloride) and graphite, all in the powder form, are taken as initial ingredients. Particles of titanium, alumina and ammonium chloride are similar in size to those described in Example 1. Particles of graphite are 0.8 mm in size. The initial ingredients are taken in the following ratio (% wt):

titanium: 82.0
alumina: 14.0
ammonium chloride: 2.0
graphite: 2.0

Said ingredients are stirred to obtain a homogeneous mixture.

The composition thus obtained is used for the diffusion layer to be formed on workpieces made of carbon steel containing 0.14% C.

The diffusion layer is being formed in the way described in Example 1. The following conditions should be maintained during the layer formation: temperature, 1150° C.; holding, 8 hours. The continuous plastic diffusion layer being formed on the surface of the workpiece has total thickness of 0.45 mm.

Similarly, samples made of 0.14% carbon content steel were treated together with said workpieces.

After the diffusion layer has been formed, the samples were subjected to X-ray analysis in order to determine the nature of phases constituting the diffusion layer and hardness, continuity and corrosion resistance of said layer were determined by the techniques described in Example 1.

The results appeared to be as follows:

Vickers hardness of the diffusion layer HV, kg/mm$^2$: 840
layer continuity, number of spots per cm$^2$: 0
corrosion resistance, mm/year:
in sodium chloride (310 g/l: 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l): 0.001
in the mixture of sodium carbonate and sodium bicarbonate (respectively 250 g/l and 50 g/l): 0.003
in potassium carbonate (100 g/l): 0.001

EXAMPLE 19

The composition for a diffusion coating of ferrous metals is obtained as follows. Titanium, alumina, crystalline ammonium halide (ammonium iodide) and graphite, all in the powder form, are taken as initial ingredients. Particles of titanium, alumina and ammonium iodide are similar in size to those described in Example 1. Particles of graphite are 0.5 mm in size. The initial ingredients are taken in the following ratio (% wt):

titanium: 78.0
alumina: 16.5
ammonium iodide: 4.0
graphite: 1.5

Said ingredients are stirred to obtain a homogeneous mixture.

The composition thus obtained is used for the diffusion layer to be formed on workpieces made of carbon steel containing 0.45% C.

The diffusion layer is being formed in the way described in Example 1. The following conditions should be maintained during the layer formation: temperature, 1150° C.; holding time, 8 hours. The continuous plastic diffusion layer being formed on the surface of workpieces has total thickness of 0.50 mm.

Similarly, samples made of 0.45% carbon content steel were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 840
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l: 0.001
in the mixture of sodium carbonate and sodium bicarbonate (respectively 250 g/l and 50 g/l): 0.003
in potassium carbonate (100 g/l): 0.001

EXAMPLE 20

The composition for a diffusion coating of ferrous metals is obtained as follows. Titanium, alumina, crystalline ammonium halide (ammonium bromide) and graphite, all in the powder form, are taken as initial ingredients. Particles of titanium alumina and ammonium bromide are similar in size to those described in Example 1. Particles of graphite are 1.5 mm in size. The initial ingredients are taken in the following ratio (% wt):

titanium: 77.0
alumina: 16.5
ammonium bromide: 5.0
graphite: 1.5

Said ingredients are stirred to obtain a homogeneous mixture.

The composition thus obtained is used for the diffusion layer to be formed on workpieces made of carbon steel containing 0.45% C.

The diffusion layer is being formed in the way described in Example 1. The following conditions should be maintained during the layer formation: temperature, 1150° C.; holding time 8 hours. The continuous plastic diffusion layer being formed on the surface of workpieces has total thickness of 0.50 mm.

Similarly, samples made of 0.4% carbon content steel were treated together with the workpieces.

After the diffusion layer has been formed, the samples were subjected to X-ray analysis in order to determine the nature of phases constituting the diffusion layer and hardness, continuity and corrosion resistance of said layer were determined by the techniques described in Example 1.

Test results appeared to be as follows:

Vickers hardness of the diffusion layer HV, kg/mm$^2$: 840
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (respectively 180 g/l and 70 g/l): 0.001
in the mixture of sodium carbonate and sodium bicarbonate (respectively 250 g/l and 50 g/l): 0.003
in potassium carbonate (100 g/l): 0.001

EXAMPLE 21

The composition for a diffusion coating of ferrous metals is obtained as follows. Titanium, alumina, crystalline ammonium halide (ammonium fluoride) and graphite, all in the powder form are taken as initial ingredients. Particles of titanium, alumina and ammonium fluoride are similar in size to those described in Example 1. Particles of graphite are 0.8 mm in size. The initial ingredients are taken in the following ratio (% wt):

titanium: 76.0
alumina: 19.0
ammonium fluoride: 3.0
graphite: 2.0

Said ingredients are stirred to obtain a homogeneous mixture.

The composition thus obtained is used for the diffusion layer to be formed on workpieces made of 0.3% carbon content steel.

The diffusion layer is being formed in the way described in Example 1. The following conditions should be maintained during the layer formation: temperature, 1150° C.; holding time, 8 hours. The continuous plastic diffusion layer being formed on the surface of the workpieces has total thickness of 0.50 mm.

Similarly, samples made of 0.3% carbon content steel were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 840
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulphate (250 g/l): 0.001
in the mixture of ammonium chloride and sodium chloride (180 g/l and 70 g/l): 0.001
in the mixture of sodium carbonate and sodium bicarbonate (250 g/l and 50 g/l): 0.003
in potassium carbonate (100 g/l): 0.001

EXAMPLE 22

The composition for a diffusion coating of ferrous metals is obtained as follows. Titanium, alumina, crystalline ammonium halide (ammonium chloride) and graphite, all in the powder form are taken as initial ingredients. Particles of titanium alumina and ammonium chloride are sizing similar to those described in Example 1. Particles of graphite are 0.8 mm in size. The initial ingredients are taken in the following ratio (% wt):

titanium: 75.0
alumina: 20.3
ammonium chloride: 3.0
graphite: 1.7

Said ingredients are stirred to obtain a homogeneous mixture.

The composition thus obtained is used for the diffusion layer to be formed on workpieces made of 0.63% carbon content steel.

The diffusion layer is being formed in the way described in Example 1. The following conditions should be maintained during the layer formation: temperature, 1200° C.; holding time, 7 hours. The continuous plastic diffusion layer being formed on the surface of the workpieces has total thickness of 0.40 to 0.42 mm.

Similarly, samples made of 0.63% carbon content steel were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness of the diffusion layer HV, kg/mm$^2$: 860
layer continuity, number of spots per cm$^2$: 0
corrosion resistance, mm/year:
in sodium chloride (310 g/l): 0.001 in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/l): 0.001
in the mixture of sodium carbonate and sodium bicarbonate (250 g/l and 50 g/l): 0.003
in potassium carbonate (100 g/l): 0.001

EXAMPLE 23

The composition for a diffusion coating of ferrous metals is obtained as follows. Titanium, alumina, crystalline ammonium halide (ammonium iodide) and graphite, all in the powder form, are taken as initial ingredients. Particles of titanium, alumina and ammonium iodide are similar in size to those described in Example 1. Particles of graphite are 1.0 mm in size. The initial ingredients are taken in the following ratio (% wt):

titanium: 76.0
alumina: 20.0
ammonium iodide: 2.7
graphite: 1.3

Said ingredients are stirred to obtain a homogeneous mixture.

The composition thus obtained is used for the diffusion layer to be formed on workpieces made of 0.75% carbon content steel.

The diffusion layer is being formed in the way described in Example 1. The following conditions should be maintained during the layer formation: temperature 1200° C.; holding time, 7 hours. The continuous plastic diffusion layer being formed on the surface of the workpieces has total thickness of 0.40 to 0.42 mm.

Similarly, samples made of 0.75% carbon content steel were treated together with the workpieces.

After the diffusion layer has been formed, the samples were subjected to X-ray analysis in order to determine the nature of phases constituting the diffusion layer, and hardness, continuity and corrosion resistance were determined by the techniques described in Example 1.

Test results appeared to be as follows:

Vickers hardness of the diffusion layer HV, kg/mm$^2$: 860
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/l): 0.001
in the mixture of sodium carbonate and sodium bicarbonate (250 g/l and 50 g/l): 0.003
in potassium carbonate (100 g/l): 0.001

EXAMPLE 24

The composition for a diffusion coating of ferrous metals is obtained as follows. Titanium, alumina, crystalline ammonium halide (ammonium bromide) and graphite, all in the powder form, are taken as initial ingredients. Particles of titanium, alumina and ammonium bromide are similar in size to those described in Example 1. Particles of graphite are 1.5 mm in size. The initial ingredients are taken in the following ratio (% wt):

titanium: 77.0
alumina: 18.5
ammonium bromide: 3.0
graphite: 1.5

Said ingredients are stirred to obtain a homogeneous mixture.

The composition thus obtained is used for the diffusion layer to be formed on workpieces such as stirrer blades and pump vanes made of 0.8% carbon content steel.

The diffusion coating is being formed in the way described in Example 1. The following conditions should be maintained during the layer formation: temperature, 1200° C.; holding time, 7 hours. The continuous plastic diffusion layer formed on the surface of the workpieces has total thickness of 0.40 to 0.42 mm.

Similarly, samples made of 0.8% carbon content steel were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness HV, kg/mm$^2$: 860
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/l): 0.001
in the mixture of sodium carbonate and sodium bicarbonate (250 g/l and 50 g/l): 0.003
in potassium carbonate (100 g/l): 0.001

EXAMPLE 25

The composition for a diffusion coating of ferrous metals is obtained as follows. Titanium, alumina, crystalline ammonium halide (ammonium fluoride) and graphite, all in the powder form are taken as initial ingredients. Particles of titanium, alumina and ammonium fluoride are similar in size to those described in Example 1. Particles of graphite are 1.2 mm in size. The initial ingredients are taken in the following ratio (% wt):

titanium: 77.5
alumina: 17.5
ammonium fluoride: 4.0
graphite: 1.0

Said ingredients are stirred to obtain a homogeneous mixture.

The composition thus obtained is used for the diffusion layer to be formed on workpieces such as pump vanes, tubes, and stirrer blades made of 0.85% carbon content steel.

The diffusion coating is being formed in the way described in Example 1. The following conditions should be maintained during the layer formation: temperature, 1200° C.; holding time, 7 hours. The continuous plastic diffusion layer being formed on the surface of the workpieces has total thickness of 0.40 to 0.42 mm.

Similarly, samples made of 0.85% carbon content steel were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness HV, kg/mm$^2$: 860 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (180 g/l and 70 g/l): 0.001 in the mixture of sodium carbonate and sodium bicarbonate (250 g/l and 50 g/l): 0.003 in potassium carbonate (100 g/l): 0.001

EXAMPLE 26

The composition for a diffusion coating of ferrous metals is obtained as follows. Titanium, alumina, crystalline ammonium halide (ammonium chloride) and graphite, all in the powder form are taken as initial ingredients. Particles of titanium, alumina and ammonium chloride are similar in size to those described in Example 1. Particles of graphite are 0.8 mm in size. The initial ingredients are taken in the following ratio (% wt):

titanium: 74.0 alumina: 20.8 ammonium chloride: 4.0 graphite: 1.2

Said ingredients are stirred to obtain a homogeneous mixture.

The composition obtained is used for the diffusion layer to be formed on workpieces such as pump vanes and slide gates made of 0.9% carbon content steel.

The diffusion layer is being formed in the way described in Example 1. The following conditions should be maintained during the layer formation: temperature, 1100° C.; holding time, 8 hours. The continuous plastic diffusion layer being formed on the surface of the workpieces has total thickness of 0.35 to 0.37 mm.

Similarly, samples made of 0.9% carbon content steel were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness HV, kg/mm$^2$: 880 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (180 g/l and 70 g/l): 0.002 in the mixture of sodium carbonate and sodium bicarbonate (250 g/l and 50 g/l): 0.002 in potassium carbonate (100 g/l): 0.001

Example 27

The composition for a diffusion coating of ferrous metals is obtained by means of stirring the following initial components taken in the following ratio (% wt):

titanium: 74.5 alumina: 20.3 ammonium i dide: 3.5 graphite: 1.7

Particles of titanium, alumina and crystalline ammonium iodide are similar in size to those described in Example 1. Particles of graphite are 1.0 mm in size. Said ingredients are stirred to obtain a homogeneous mixture.

The composition thus obtained is used for the diffusion layer to be formed on workpieces made of 1% carbon content steel.

The diffusion coating is being formed in the way described in Example 1. The following conditions should be maintained during the layer formation: temperature, 1100° C.; holding time, 8 hours. The diffusion layer being formed on the surface of the workpieces has total thickness of 0.35 to 0.37 mm.

Similarly, samples made of 1% carbon content steel were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1. Particles of graphite are 1.2 mm in size. Said ingredients are stirred to obtain a homogeneous mixture.

The composition thus obtained is used for the diffusion coating to be formed on workpieces made of 1.2% carbon content steel.

The diffusion coating is being formed in the way described in Example 1. The following conditions should be maintained during the coating formation: temperature, 1100° C.; holding time, 8 hours. The diffusion layer formed on the surface of the workpieces has total thickness of 0.35 to 0.37 mm.

Similarly, samples made of 1.2% carbon content steel were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness HV, kg/mm$^2$: 880 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (180 g/l and 70 g/l): 0.002 in the mixture of sodium carbonate and sodium bicarbonate (250 g/l and 50 g/l): 0.002 in potassium carbonate (100 g/l): 0.001

Example 28

The composition for a diffusion coating of ferrous metals is obtained by stirring the following initial components taken in the following ratio (% wt):

titanium: 75.0 alumina: 20.6 ammonium bromide: 3.0 graphite: 1.4

Particles of titanium, alumina and crystalline ammonium bromide are similar in size to those described in Example 1. Particles of graphite are 1.2 mm in size. Said ingredients are stirred to obtain a homogeneous mixture.

The composition thus obtained is used for the diffusion coating to be formed on workpieces made of 1.2% carbon content steel.

The diffusion coating is being formed in the way described in Example 1. The following conditions should be maintained during the layer formation: temperature, 1100° C.; holding time, 8 hours. The diffusion layer formed on the surface of the workpieces has total thickness of 0.35 to 0.37 mm.

Similarly, samples made of 1.2% carbon content steel were treated together with the workpieces.

After the diffusion layer has been formed, the samples were subjected to X-ray analysis in order to determine the narure of phases constituting the diffusion layer, and hardness, continuity and corrosion resistance of said layer were determined by the techniques described in Example 1.

Test results appeared to be as follows:

Vickers hardness HV, kg/mm$^2$: 880 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulphate (250 g/l): 0.001 in the mixture of ammonium chloride and sodium chloride (180 g/l and 70 g/l): 0.002 in the mixture of sodium carbonate and sodium bicarbonate 250 g/l and 50 g/l): 0.002 in potassium carbonate (100 g/l): 0.001

Example 29

The composition for a diffusion coating of ferrous metals is obtained by stirring the following initial components taken in the following ratio (% wt):

titanium: 76.0 alumina: 20.3 ammonium fluoride: 2.5 graphite: 1.2

Particles of titanium, alumina and crystalline ammonium fluoride are similar in size to those described in Example 1. Particles of graphite are 1.5 mm in size. Said ingredients are stirred to obtain a homogeneous mixture.

The composition thus obtained is used for the diffusion coating to be formed on workpieces made of carbon steel containing 1.2% C.

The diffusion coating is being formed in the way described in Example 1. The following conditions should be maintained during the layer formation: temperature 1100° C., holding for 8 hours. The diffusion layer being formed on the surface of workpieces has total thickness of 0.35 to 0.37 mm.

Similarly, samples made of 1.2% carbon content steel were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness HV, kg/mm$^2$: 880 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (180 g/l and 70 g/l): 0.002 in the mixture of sodium carbonate and sodium bicarbonate (250 g/l and 50 g/l): 0.002 in potassium carbonate: 0.001

Example 30

The composition for a diffusion coating of ferrous metals is obtained as follows. Titanium, alumina, crystalline ammonium halide (ammonium chloride) and graphite, all in the powder form, are taken an initial ingredients. Particles of titanium, alumina and ammonium chloride are similar in size to those described in Example 1. Particles of graphite are 1.2 mm in size. The initial ingredients are taken in the following ratio (% wt):

titanium: 82.0 alumina: 14.3 ammonium chloride: 2.0 graphite: 1.7

Said ingredients are stirred to obtain a homogeneous mixture.

The composition thus obtained is used for the diffusion coating to be formed on workpieces made of alloy steel containing 0.1% carbon, 0.6% silicon, 13% chromium and 0.6% manganese.

The diffusion coating is being formed in the way described in Example 1. The following conditions should be maintained during the layer formation: temperature, 1150° C.; holding time, 7 hours. The continuous plastic diffusion layer being formed on the surface of the workpieces has total thickness of 0.38 to 0.40 mm.

Similarly, samples made of alloy steel containing 0.1% carbon, 0.6% silicon, 13% chromium and 0.6% manganese were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness HV, kg/mm$^2$: 840 layer continuity, number of spots per cm$^2$: 0 corrosion resistance, mm/year:

in sodium chloride (310 g/l): 0.001 in magnesium chloride (250 g/l): 0.001 in barium chloride (263 g/l): 0.001 in sodium sulfate (250 g/l): 0.001 in the mixture of ammonium chloride and sodium chloride (180 g/l and 70 g/l): 0.004 in the mixture of sodium carbonate and sodium bicarbonate (250 g/l and 50 g/l): 0.002 in potassium carbonate (100 g/l): 0.001

Example 31

The composition for a diffusion coating of ferrous metals is obtained as follows. Titanium, alumina, ammonium halide (ammonium iodide) and graphite, all in the powder form, are taken as initial ingredients. Particles of titanium, alumina and ammonium iodide are similar to in size those described in Example 1. Particles of graphite are 1.5 mm in size. Initial ingredients are taken in the following ratio (% wt):

titanium: 80.0
alumina: 15.2
ammonium iodide: 3.0
graphite: 1.8

Said ingredients are stirred to obtain a homogeneous mixture. The composition obtained is used for the diffusion coating to be formed on workpieces made of alloy steel described in Example 30.

The diffusion coating is being formed in the way described in Example 1. The following conditions should be maintained during the layer formation: temperature, 1150° C.; holding time, 7 hours. The continuous plastic diffusion layer formed on the surface of workpieces has total thickness of 0.38 to 0.40 mm.

Similarly, samples made of alloy stell containing 0.1% carbon, 0.6% silicon, 0.6% manganese and 13% chromium were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:
Vickers hardness HV, kg/mm$^2$: 840
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/l): 0.004
in the mixture of sodium carbonate and sodium bicarbonate (250 g/l and 50 g/l): 0.002
in potassium carbonate (100 g/l): 0.001

Example 32

The composition for a diffusion coating of ferrous metals is obtained as follows. Titanium, alumina, ammonium halide (ammonium bromide) and graphite, all in the powder form, are taken as initial ingredients. Particles of titanium, alumina and ammonium bromide are similar in size to those described in Example 1. Particles of graphite are 0.8 mm in size. The initial ingredients are taken in the following ratio (% wt):
titanium: 79.0
alumina: 16.0
ammonium bromide: 3.5
graphite: 1.5

Said ingredients are stirred to obtain a homogeneous mixture. The composition obtained is used for the diffusion coating to be formed on workpieces made of alloy steel described in Example 30. The diffusion coating is being formed in the way described in Example 1. The following conditions should be maintained during the layer formation: temperature, 1150° C.; holding time, 7 hours. The continuous plastic diffusion layer formed on the surface of workpieces has total thickness of 0.38 to 0.40 mm.

Similarly, samples made of alloy steel containing 0.1% carbon, 0.6% silicon, 0.6% manganese and 13% chromium were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:
Vickers hardness HV, kg/mm$^2$: 840
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/l): 0.005
in the mixture of sodium carbonate and sodium bicarbonate (250 g/l and 50 g/l): 0.002
in potassium carbonate (100 g/l): 0.001

Example 33

The composition for a diffusion coating of ferrous metals is obtained as follows. Titanium, alumina, ammonium halide (ammonium chloride) and graphite, all in the powder form, are taken as initial ingredients. Particles of titanium, alumina and ammonium chloride are similar in size to those described in Example 1. Particles of graphite are 0.8 mm in size. The initial ingredients are taken in the following ratio (% wt):
titanium: 80.0
alumina: 15.6
ammonium chloride: 3.0
graphite: 1.4

Said ingredients are stirred to obtain a homogeneous mixture. The composition obtained is used for the diffusion coating to be formed on workpieces made of alloy steel containing 0.25% carbon, 0.8% silicon, 0.8% manganese and 17% chromium.

The diffusion coating is being formed in the way described in Example 1. The following conditions should be maintained during the layer formation: temperature 1150° C.; holding time, 7 hours. The continuous plastic diffusion layer formed on the surface of workpieces has total thickness of 0.40 to 0.43 mm.

Similarly, samples made of alloy steel containing 0.25% carbon, 0.8% silicon, 0.8% manganese and 17% chromium were treated together with the workpieces.

After the diffusion layer has been formed, the samples were subjected to X-ray analysis in order to determine the nature of phase constituting the diffusion layer, and hardness, continuity and corrosion resistance of said layer were determined by techniques described in Example 1.

Test results appeared to be as follows:
Vickers hardness HV, kg/mm$^2$: 860
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/1): 0.005
in the mixture of sodium carbonate and sodium bicarbonate (250 g/l and 50 g/l): 0.002
in potassium carbonate (100 g/l): 0.001

Example 34

The composition for a diffusion coating of ferrous metals is obtained as follows. Titanium, alumina, crystalline ammonium halide (ammonium iodide) and graphite, all in the powder form are taken as initial ingredients. Particles of titanium, alumina and ammonium iodide are similar in size to those described in Example 1. Particles of graphite are 1.0 mm in size. The initial ingredients are taken in the following ratio (% wt):

titanium: 80.5
alumina: 15.8
ammonium iodide: 2.0
graphite: 1.7

Said ingredients are stirred to obtain a homogeneous mixture. The composition obtained is used for the diffusion coating to be formed on workpieces made of alloy steel described in Example 33.

The diffusion coating is being formed in the way described in Example 1. The following conditions should be maintained during the layer formation: temperature, 1150° C.; holding time, 7 hours. The continuous plastic diffusion layer formed on the surface of workpieces has total thickness of 0.40 to 0.43 mm.

Similarly, samples made of alloy steel described in Example 33 were treated together with said workpieces.

After the diffusion layer ahs been formed, the samples were subjected to X-ray analysis in order to determine the nature of phase constituting the diffusion layer, and hardness, continuity and corrosion resistanct of said layer were determined by the techniques described in Example 1.

Test results appeared to be as follows:

Vickers hardness HV, kg/mm$^2$: 860
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/l): 0.005
in the mixture of sodium carbonate and sodium bicarbonate (250 g/l and 50 g/l): 0.002
in potassium carbonate (100 g/l): 0.001

Example 35

The composition for a diffusion coating of ferrous metals is obtained as follows. Titanium, alumina, crystalline ammonium halide (ammonium fluoride) and graphite, all in the powder form, are taken as initial ingredients. Particles of titanium, alumina and ammonium fluoride are similar in size to those described in Example 1. Particles of graphite are 0.8 mm in size. The initial ingredients are taken in the following ratio (% wt):

titanium: 81.0
alumina: 15.7
ammonium fluoride: 2.0
graphite: 1.3

Said ingredients are stirred to obtain a homogeneous mixture. The composition obtained is used for the diffusion coating to be formed on workpieces made of alloy steel described in Example 33.

The diffusion coating is being formed in the way described in Example 1. The following conditions should be maintained during the layer formation: temperature, 1150° C.; holding time, 7 hours. The continuous plastic diffusion layer being formed on the surface of the workpiece has total thickness of 0.40 to 0.43 mm.

Similarly, samples made of the alloy steel described in Example 33 were treated together with the workpieces.

After the diffusion layer has been formed, the samples were subjected X-ray analysis in order to determine the nature of phases constituting the diffusion layer, and hardness, continuity and corrosion resistance of said layer were determined by the techniques described in Example 1.

Test results appeared to be as follows:

Vickers hardness HV, kg/mm$^2$: 860
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/l): 0.005
in the mixture of sodium carbonate and sodium bicarbonate (250 g/l and 50 g/l): 0.002
in potassium carbonate (100 g/l): 0.001

Example 36

The composition for a diffusion coating of ferrous metals is obtained as follows. Titanium, alumina, crystalline ammonium halide (ammonium chloride) and graphite, all in the powder form, are taken as initial ingredients.

Particles of titanium, alumina and ammonium chloride are similar in size to those described in Example 1. Particles of graphite are 0.8 mm in size. The initial ingredients are taken in the following ratio (% wt):

titanium: 79.5
alumina: 16.7
ammonium chloride: 2.5
graphite: 1.3

Said ingredients are stirred to obtain a homogeneous mixture.

With the composition obtained the diffusion layer on workpieces such as pump vanes, fittings, valves, parts of housings for column apparatus and bolts made of alloy steel containing 1% carbon, 1% silicon, 1.5% manganese, 0.3% chromium and 0.3% nickel is formed in the way described in Example 1. However, heating is carried out up to 1100° C., and holding time is 6 hours.

The continuous plastic diffusion layer being formed on the surface of the workpieces has a total thickness of 0.32 to 0.38 mm.

Similarly, samples together with the workpieces were treated in the same container in order to form a diffusion layer on the surface thereof. Said samples were made of alloy steel containing 1% carbon, 1% silicon, 1.5% manganese, 0.3% chromium and 0.3% nickel, and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness HV, kg/mm$^2$: 860
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/l): 0.003 in the mixture of sodium carbonate and sodium bicarbonate (250 g/l and 50 g/l): 0.002
in potassium carbonate (100 g/l): 0.001

EXAMPLE 37

The composition for a diffusion coating of ferrous metals is obtained as follows. Titanium, alumina, crystalline ammonium halide (ammonium bromide) and graphite, all in the powder form, are taken as initial ingredients. Particles of titanium, alumina and ammonium bromide are similar in size to those described in Example 1. Particles of graphite are 1.2 mm in size. The initial ingredients are taken in the following ratio (% wt):
titanium: 78.0
alumina: 16.7
ammonium bromide: 3.5
graphite: 1.8

Said ingredients are stirred to obtain a homogeneous mixture.

With the composition obtained the diffusion layer on workpieces such as pump vanes, fittings, valves, parts of housings for column apparatus in manufacture of soda made of alloy steel described in Example 36 is formed in the way described in Example 1. However, heating is carried out up to 1100° C., and holding time is 6 hours.

The continuous plastic diffusion layer formed on the surface of the workpieces has total thickness of 0.32 to 0.38 mm.

Similarly, samples together with the workpieces were treated in the same container in order to form a diffusion layer on the surface thereof. The samples were made of alloy steel described in Example 36, and were 65×15×3 mm rectangular plates.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:
Vickers hardness HV, kg/mm$^2$: 860
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/l): 0.003
in the mixture of sodium carbonate and sodium bicarbonate (250 g/l and 50 g/l): 0.002
in potassium carbonate (100 g/l): 0.001

EXAMPLE 38

The composition for a diffusion coating of ferrous metals is obtained as follows. Titanium, alumina, crystalline ammonium halide (ammonium fluoride) and graphite, all in the powder form, are taken as initial ingredients.

Particles of titanium, alumina and ammonium fluoride are similar in size to those described in Example 1. Particles of graphite are 0.9 mm in size. The initial ingredients are taken in the following ratio (% wt):
titanium: 78.5
alumina: 17.5
ammonium fluoride: 2.0
graphite: 2.0

Said ingredients are stirred to obtain a homogeneous mixture.

With the composition obtained the diffusion layer on workpieces such as pump vanes, fittings, valves and parts of housings for column apparatus in manufacture of soda made of alloy steel described in Example 36 is formed in the way described in Example 1. However, heating is carried out up to 1100° C., and holding time is 6 hours.

The continuous plastic diffusion layer formed on the surface of the workpieces has total thickness of 0.32 to 0.38 mm.

Similarly, samples together with the workpieces were treated in the same container in order to form a diffusion layer on the surface thereof. The samples were made of alloy steel described in Example 36, and were 65×15×3 mm rectangular plates.

After the diffusion layer has been formed, the samples were subjected to X-ray analysis in order to determine the nature of phases consituting the diffusion layer, and hardness, continuity and corrosion resistance of said layer were determined by the techniques described in Example 1.

Test results appeared to be as follows:
Vickers hardness HV, kg/mm$^2$: 860
layer continuity, number of spots per cm$^2$: 0
corrosion resistance, mm/year:
in sodium chloride (310 g/l): 0.001
in magnesium chloride (250 g/l): 0.001
in barium chloride (263 g/l): 0.001
in sodium sulfate (250 g/l): 0.001
in the mixture of ammonium chloride and sodium chloride (180 g/l and 70 g/l): 0.003
in the mixture of sodium carbonate and sodium bicarbonate (250 g/l and 50 g/l): 0.002
in potassium carbonate (100 g/l): 0.001

EXAMPLE 39

The composition for a diffusion coating of ferrous metals is obtained as follows. Titanium, alumina, crystalline ammonium halide (ammonium chloride) and graphite, all in the powder form, are taken as initial ingredients. Particles of titanium, alumina and ammonia chloride are similar in size to those described in Example 1. Particles of graphite are 0.8 mm in size. The initial ingredients are taken in the following ratio (% wt):
titanium: 75.0
alumina: 20.5
ammonium chloride: 4.0
graphite: 0.5

Said ingredients are stirred to obtain a homogeneous mixture. Amount of graphite in mixture is lower than it is required according to the invention.

The composition obtained is used for the diffusion layer to be formed on workpieces made of 1.2% carbon content steel.

The diffusion layer is being formed in the way described in Example 1. The following conditions should be maintained during the layer formation: temperature, 1100° C., holding time, 8 hours. The diffusion layer formed on the surface of the workpieces has total thickness of 0.3 mm.

Similarly, samples made of 1.2% carbon content steel were treated together with the workpieces.

After the diffusion layer has been formed, the samples were subjected to X-ray analysis in order to determine the nature of phases constituting the diffusion layer and hardness, continuity and corrosion resistance of said layer were determined by the techniques described in Example 1.

Test results appeared to be as follows:

Vickers hardness HV, kg/mm$^2$: 1000 layer continuity, number of spots per cm$^2$: 2 corrosion resistance, mm/year in the mixture of ammonium chloride and sodium chloride (180 g/l and 70 g/l): 0.035

It becomes evident that decreased carbon content in the mixture results in sharp decrease in corrosion resistance of the diffusion layer, and in breaking of its continuity.

EXAMPLE 40

The composition for a diffusion coating of ferrous metals is obtained as follows. Titanium, alumina, crystalline ammonium halide (ammonium chloride) and graphite, all in the powder form, are taken as initial ingredients. Particles of titanium, alumina and ammonium chloride are similar in size to those described in Example 1. Particles of graphite are 1.5 mm in size. The initial ingredients are taken in the following ratio (% wt):

titanium: 80.0
alumina: 15.0
ammonium chloride: 2.0
graphite: 3.0

Said ingredients are stirred to obtain a homogeneous mixture. Amount of carbon in the mixture is higher than it is required according to the invention.

The composition obtained is used for the diffusion layer to be formed on workpieces made of grey cast iron containing 3.5% C.

The diffusion layer is being formed in the way described in Example 1. The following conditions should be maintained during the layer formation: temperature, 950° C.; holding time, 7 hours. The diffusion layer formed on the surface of the workpieces has an extremely inhomogeneous thickness. Said workpieces cannot be used for purposes thereof.

EXAMPLE 41

The composition for a diffusion coating of ferrous metals is obtained as follows. Titanium, alumina, crystalline ammonium halide (ammonium chloride) and graphite, all in the powder form, are taken as initial ingredients. Particles of titanium, alumina and ammonium chloride are similar in size to those described in Example 1. Particles of graphite are 1.5 mm in size. The initial ingredients are taken in the following ratio (% wt):

titanium: 83.0
alumina: 9.0
ammonium chloride: 5.0
graphite: 3.0

Said ingredients are stirred to obtain a homogeneous mixture. Amount of titanium and carbon in the mixture is higher and amount of alumina is lower than required according to the invention.

The comparison thus obtained is used for the diffusion layer to be formed on workpieces and samples made of 0.9% carbon content steel.

The diffusion layer is being formed in the way described in Example 1. The following conditions should be maintained during the layer formation: temperature, 1200° C.; holding time, 7 hours. Due to the sintering of powders constituting the mixture, the diffusion layer is not being formed.

EXAMPLE 42

The composition for a diffusion coating of ferrous metals is obtained as follows. Titanium, alumina, crylstalline ammonium halide (ammonium chloride) and graphite, all in the powder form, are taken as initial ingredients. Particles of titanium, alumina and ammonium chloride are similar in size to those described in Example 1. Particles of graphite are 0.8 mm in size. The initial ingredients are taken in the following ratio (% wt):

titanium: 68.0
alumina: 26.0
ammonium chloride: 5.0
graphite: 1.0

Said ingredients are stirred to obtain a homogeneous mixture. Amount of titanium in the mixture is lower and amount of alumina is higher than requred according to the invention.

The composition obtained is used for the diffusion layer to be formed on workpieces made of 0.9% carbon content steel.

The diffusion layer is being formed in the way described in Example 1. The following conditions should be maintained during the layer formation: temperature, 1200° C.; holding time, 7 hours. The diffusion layer formed on the surface of workpieces has total thickness of 0.38 mm.

Similarly, samples made of 0.9% carbon content steel were treated together with the workpieces.

After the diffusion layer has been formed, the samples were subjected to X-ray analysis in order to determine the nature of phases constituting the diffusion layer, and hardness, continuity and corrosion resistance of said layer were determined by the techniques described in Example 1.

Test results appeared to be as follows:

Vickers hardness HV, kg/mm$^2$: 840 layer continuity, number of spots per cm$^2$: 2 corrosion resistance, mm/year:

in the mixture of ammonium chloride and sodium chloride (180 g/l and 70 g/l): 0.040

As can be seen from above data, change in contents of any ingredient beyond the limits specified in the invention leads either to a sharp decrease in corrosion resistance or does not make it possible to obtain the diffusion layer at all.

While it can be clearly understood that only some specific examples of the invention are above described, numerous modifications and variations may be made in the invention without departing from the spirit and scope thereof as set forth in the appended claims.

What is claimed is:

1. A composition for a diffusion coating of ferrous metals containing a particulate mixture of titanium in an amount of 70.0 to 82.0% wt alumina in an amount of 14.5 to 20.0% wt ammonium halide in an amount of 2.0 to 5.0% wt and graphite in an amount of 1.0 to 2.0% wt.

2. A composition according to claim 1, containing graphite in the form of powder with particle size ranging from 0.8 to 1.5 mm.

* * * * *